US006814263B2

(12) United States Patent
Rosenthal

(10) Patent No.: US 6,814,263 B2
(45) Date of Patent: Nov. 9, 2004

(54) PUMP

(75) Inventor: Karl-Heinz Rosenthal, Reichshof/Oberagger (DE)

(73) Assignee: Karl-Heinz Rosenthal, Reichshof/Oberagger (DE)

( * ) Notice: Subject to any disclaimer, the term of this patent is extended or adjusted under 35 U.S.C. 154(b) by 154 days.

(21) Appl. No.: 10/240,956

(22) PCT Filed: Mar. 21, 2001

(86) PCT No.: PCT/IB01/00661

§ 371 (c)(1),
(2), (4) Date: Oct. 4, 2002

(87) PCT Pub. No.: WO01/76766

PCT Pub. Date: Oct. 18, 2001

(65) Prior Publication Data

US 2003/0106906 A1 Jun. 12, 2003

(30) Foreign Application Priority Data

Apr. 7, 2000 (DE) ..... 100 17 340

(51) Int. Cl.[7] ..... B65D 88/54
(52) U.S. Cl. ..... 222/321.7
(58) Field of Search ..... 222/321.7, 382, 222/481.5

(56) References Cited

U.S. PATENT DOCUMENTS

| | | | | |
|---|---|---|---|---|
| 3,527,551 A | | 9/1970 | Kutik et al. | 417/560 |
| 4,046,495 A | | 9/1977 | Grimm | 417/268 |
| 4,168,020 A | | 9/1979 | Benson | 222/207 |
| 4,371,097 A | | 2/1983 | O'Neill | 222/321 |
| 5,282,552 A | * | 2/1994 | Ophardt | 222/321.7 |
| 5,373,970 A | * | 12/1994 | Ophardt | 222/325 |
| 5,518,377 A | | 5/1996 | Bougamont | 417/446 |
| 5,975,360 A | | 11/1999 | Ophardt | 222/83 |
| 6,186,369 B1 | | 2/2001 | Rosenthal | 222/321.7 |
| 6,406,207 B1 | | 6/2002 | Wiegner et al. | 401/272 |
| 6,557,736 B1 | * | 5/2003 | Ophardt | 222/321.7 |

FOREIGN PATENT DOCUMENTS

| | | | |
|---|---|---|---|
| DE | 87 11 365 | 2/1989 | F04B/19/00 |
| DE | 196 45 393 | 2/1998 | F04B/9/14 |
| DE | 197 29 516 | 4/1999 | B65D/83/00 |
| EP | 0 553 546 | 1/1997 | B65D/47/34 |
| EP | 0 795 354 | 9/1997 | B05B/11/00 |
| EP | 0 598 237 | 4/1998 | B05B/11/00 |
| WO | WO 89/01365 | 2/1989 | B05B/11/00 |

* cited by examiner

*Primary Examiner*—Philippe Derakshani
(74) *Attorney, Agent, or Firm*—Grossman Tucker Perreault & Pfleger, PLLC

(57) ABSTRACT

The invention relates to a pump for flowable media, particularly a cosmetic pump, provided with a base (1), which can be mounted tightly on the opening of a container, a through-hole (9) in the base (1), which extends from the underside of the base through to its top side, a tube sleeve (12) extending upwards from the top side of the base (1) around the through-hole (9), a guide sleeve (15) likewise extending upwards from the top side of the base, a top part (2) guided on the guide sleeve (15) that can be depressed against a compression spring (16), a compression chamber (23) with an inlet valve (24) and an outlet valve (25), and an outlet channel (33) provided downstream of the outlet valve (25). In order to simplify the design of the pump, both the inlet valve (24) and the outlet valve (25) of the compression chamber (23) are designed as integrally moulded lip seals, where the medium is drawn into the compression chamber (23) by the upward travel of the top part (2) induced by spring force and forced out of the compression chamber (23) when the top part (2) is depressed.

10 Claims, 3 Drawing Sheets

PUMP

Figure 1:
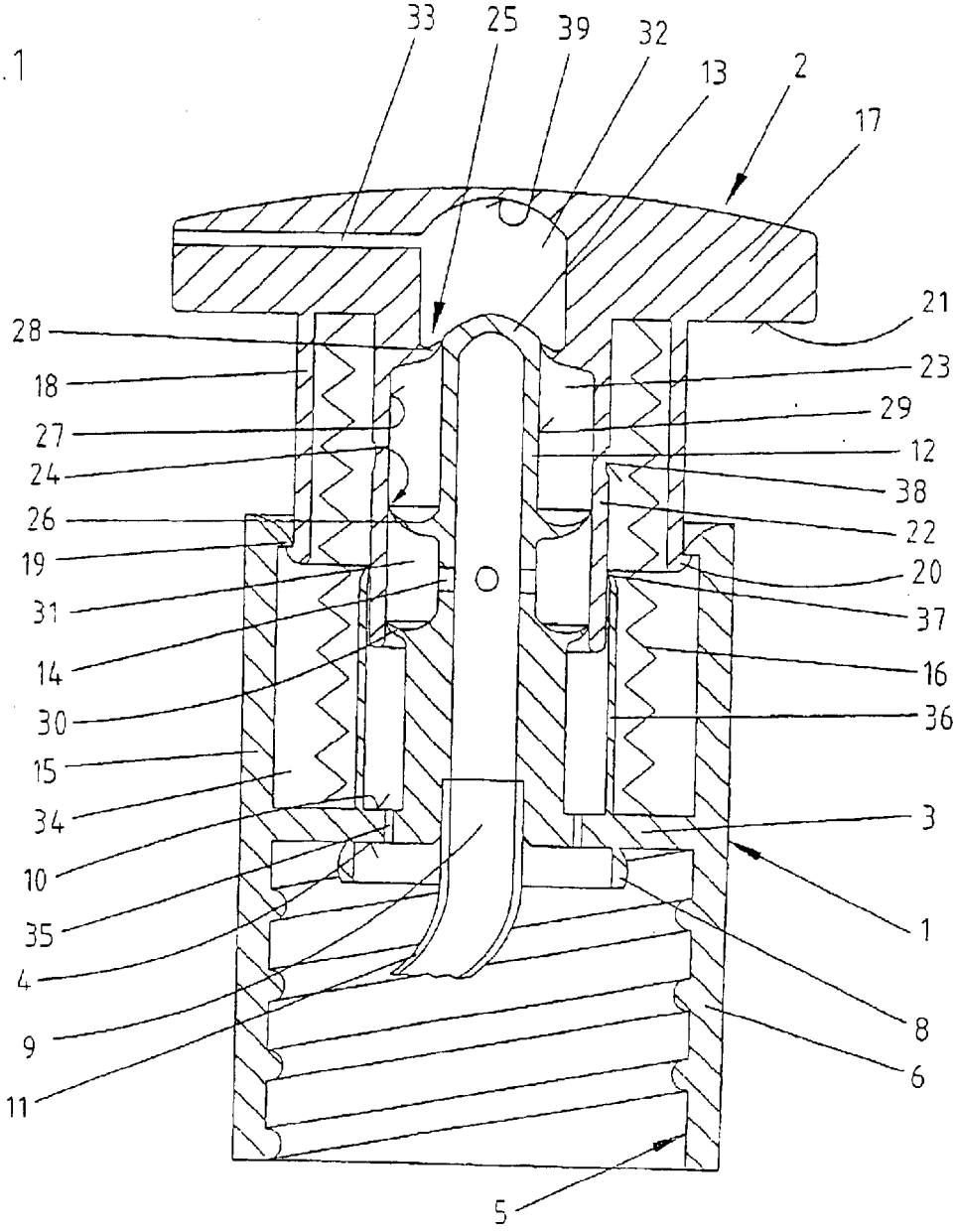

The invention relates to a pump for flowable media, particularly a cosmetic pump, provided with a base, which can be mounted tightly on the opening of a container and, when mounted, has an underside facing the container and a top side facing away from the container, a through-hole in the base, which extends from the underside of the base through to its top side, a tube sleeve extending upwards from the top side of the base around the through-hole, an outer guide sleeve extending upwards from the top side of the base, a top part guided on the guide sleeve that can be manually depressed against a compression spring, a compression chamber adjacent to the tube sleeve with an inlet valve and an outlet valve, an outlet channel provided downstream of the outlet valve of the compression chamber, a mounting element provided on the underside of the base for connecting the base to the container, a riser tube extending from the through-hole into the container for drawing in the flowable medium and a forced-ventilation element to the inside of the container that is active when the top part is depressed.

Pumps of the kind described are mass-produced components that are usually intended to discharge the contents of a single container and then have to be disposed of. They serve to transport various flowable media, particularly in the field of body and beauty care, where cleansing lotions, creams and the like are to be pumped to the outlet opening of the respective container, for example.

Pumps of this kind must be inexpensive to manufacture and easy to assemble, because their price should not significantly increase the total price of the product, comprising the container, the contents and the pump.

Various designs of pumps of this kind are known, such as from German patent 19 645 393.

The object of the invention is to further simplify the design of a pump of this kind.

According to the invention the object is solved in that both the inlet valve and the outlet valve of the compression chamber are designed as integrally moulded lip seals that only allow the medium to pass in the direction of transport, where the medium is drawn into the compression chamber by the upward travel of the top part induced by spring force and forced out of the compression chamber when the top part is depressed, the lip seal that serves as the inlet valve is preferably located on the outer periphery of the tube sleeve with its sealing lip in contact with the inner surface of the chamber sleeve, and in that the lip seal that serves as the outlet valve of the compression chamber can be located on the inner periphery of the chamber sleeve provided on the top part with its sealing lip in contact with the outer surface of the tube sleeve.

In this way, the compression chamber, which is enclosed by the two lip seals, is formed between the tube sleeve integrally moulded on the base and the chamber sleeve provided on the top part. As a result, no separate parts that can shift relative to one another are required to form the valve area, as is the case with the known pumps.

A pump of this kind consists of a maximum of three parts, namely the base, the depressible top part and a restoring spring.

If the restoring spring is integrally moulded on the top part, or possibly on the base, the pump according to the invention can be made of two parts, which need only be pressed together after being produced.

The tube sleeve of the base can be designed as an elongated cylinder that is closed at the top end.

In a design of this kind, the compression chamber is expediently located between the outer surface of the tube sleeve and the inner surface of a chamber sleeve located on the top part concentric to the tube sleeve.

The tube sleeve can expediently be provided below the lip seal with at least one aperture for the medium to be transported, which thus exits the tube sleeve below the lip seal.

A displacement chamber, into which the tube sleeve designed as a cylinder closed at the top projects, is expediently located above the outlet valve inside the chamber sleeve and/or the top part. Thus, when the top part is depressed, not only is the medium to be transported pumped through the outlet valve towards the outlet channel, but the displacement chamber also becomes successively smaller, thus intensifying the pump effect.

The downward movement of the top part can be limited by the top end of the tube sleeve hitting the top end of the displacement chamber, meaning that no additional stops need be integrally moulded.

Another circumferential sealing lip, which also contacts the inner surface of the chamber sleeve, can be provided below the aperture on the outer periphery of the tube sleeve, where the area between the two sealing lips provided on the tube sleeve forms an intermediate chamber. From this intermediate chamber, the medium to be transported can only be pumped towards the compression chamber, while the passage of the medium downwards into the other parts of the pump is prevented by the lower sealing lip.

Furthermore, the base can be provided with a sealing lip that contacts the outer periphery of the chamber sleeve, thus preventing air from entering the pump from the outside during the pumping cycle. In order to nonetheless ensure forced ventilation to the inside of the container after the pumping cycle, the outer periphery of the chamber sleeve can have at least one recess, which is in the region of the sealing lip when the top part is depressed and thus creates an air opening. At the same time, at least one air passage is expediently provided in the base between the tube sleeve and the sealing lip, through which the air can directly enter the container.

The top part is expediently provided with a corresponding guide sleeve that interacts with the guide sleeve of the base. The two guide sleeves not only serve as the outsides of the pump, but can also be provided with stops to limit the upward stroke of the top part.

The tube sleeve of the base and the chamber sleeve of the top part can be concentric relative to one another.

An example of the invention is illustrated in the drawing and described in detail below based on the drawing. The drawings show the following:

FIG. 1 A cross-section of a practical example of the pump in the normal position, FIG. 2 The same cross-section with the top part in its depressed position, FIG. 3 The two, separate pump parts immediately prior to assembly, In the following description, it is assumed that the parts shown at the top in the drawing are actually located at the top, although this view is relative, because the pump can, of course, also be operated when the container is tilted or pointed down 180°.

The two practical examples of the pump illustrated in the drawings serve to transport liquid or flowable media, particularly skin care products, cleansing and shower liquids, shampoo and the like.

Figure 2:
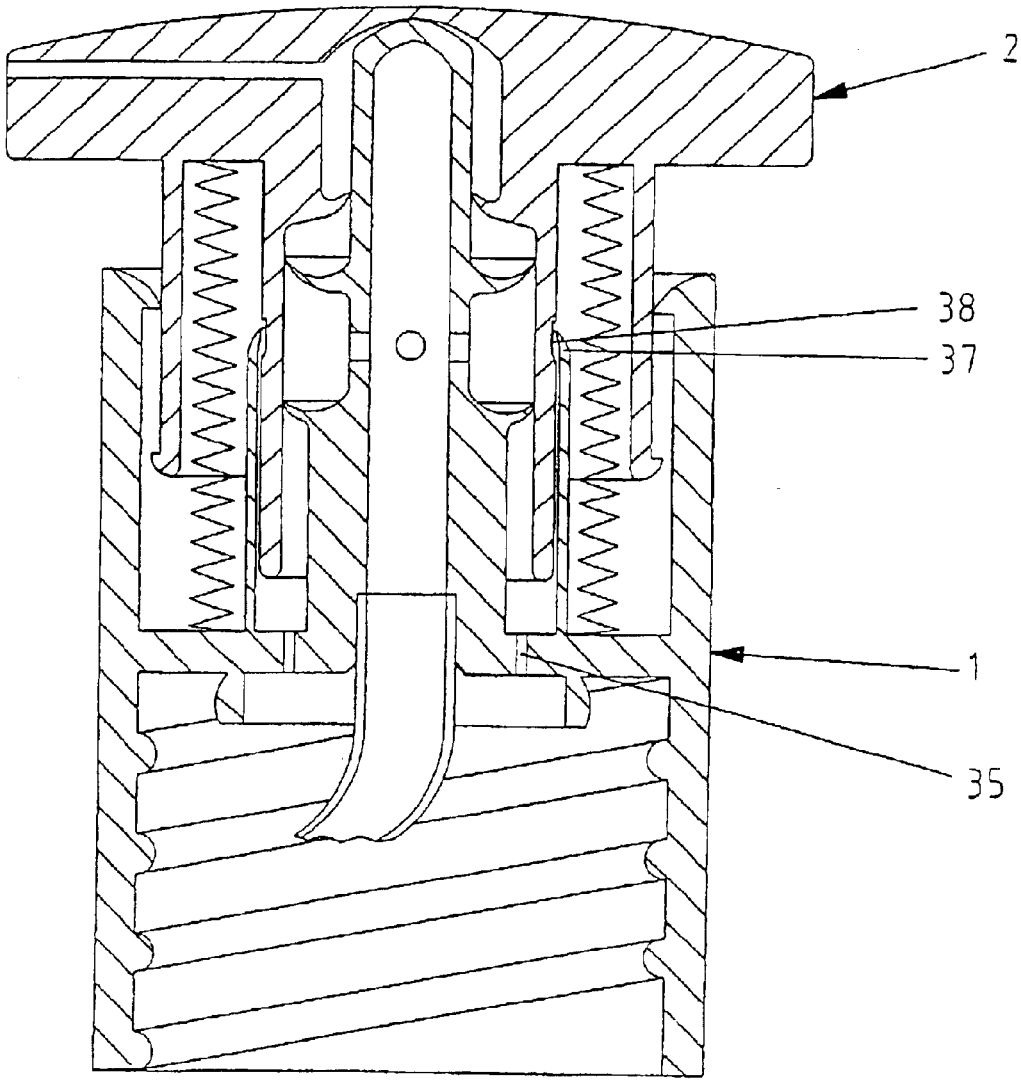
Figure 3:
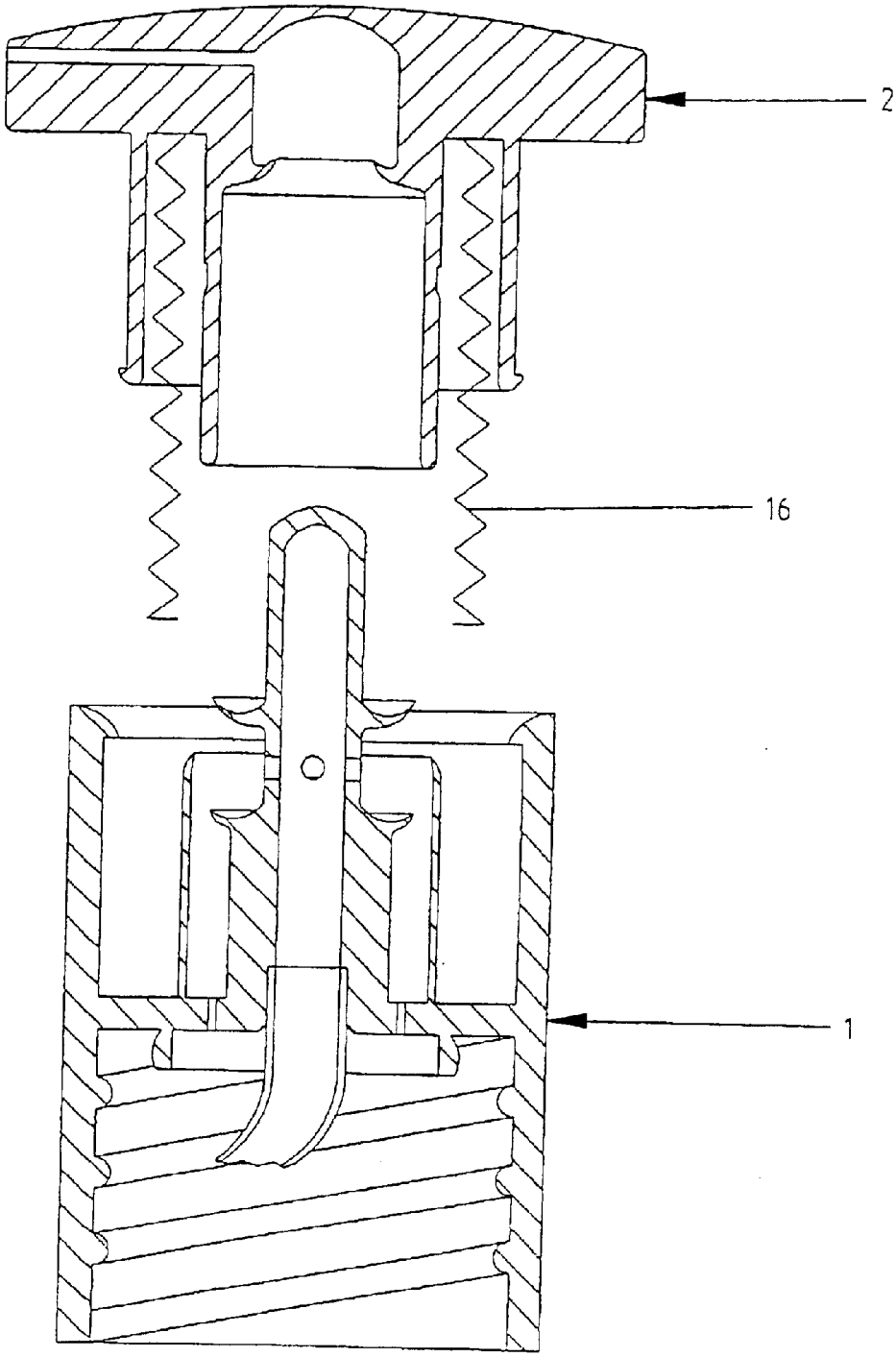

According to FIGS. 1 to 3, the pump essentially consists of a base 1 and a top part 2, which can be depressed manually relative to base 1. All the other functional parts can be integrally moulded on these two parts, i.e. only two individual parts are required to produce the pump, each of which can be manufactured in a single working step. The two parts are designed as plastic injection mouldings, where a plastic is used that must be elastically deformable, at least in thinly moulded areas.

The base comprises a base plate 3, which can be placed in tight contact on the opening of a container (not shown in the drawing). For this purpose, underside 4 of the base is provided with a mounting element 5.

In the practical example shown in FIGS. 1 to 3, the mounting element is provided for a glass or plastic bottle, which also has a threaded neck at its top end. Consequently, mounting element 5 comprises a cylindrical connector 6, extending down from base 1, that is provided with projecting threads 7 on its inner periphery. The connector is screwed onto the thread of the bottle. A seal 8 reaches into the bottle and comes into contact with the inner surface of the bottle neck under pretension when the pump is screwed onto the bottle, thus creating a tight connection.

If the containers to which the pump is to be connected have other openings, mounting element 5 must be adapted accordingly. For example, simple push-in snap connections, crimp connections and the like are known.

A through-hole 9 is provided in the centre of base plate 3 that extends from the underside of base plate 3 to its top side 10.

A riser tube 11, which is designed as a commercially available plastic tube, for example, is inserted into through-hole 9 from below and extends into the lower region of the container (not shown in the drawing) in order to draw in the flowable medium to be transported.

In extension of through-hole 9, a tube sleeve 12 extends vertically upwards from top side 10 of base plate 3 around the centre axis of base plate 3. The top end of the tube sleeve is sealed by an integrally moulded cap 13, while several radial apertures 14, distributed over the circumference, are provided at roughly half the height of tube sleeve 12.

Furthermore, outer guide sleeve 15, which extends upwards from top side 10 of base plate 3, and downward-facing connector 6 together form a common, cylindrical, outer surface.

Separately designed top part 2 which, when assembled, can be depressed relative to base 1 against the force of spring 16, has a head 17 that is depressed with one finger or several fingers in order to operate the pump. The bottom of head 17 is connected to a cylindrical guide sleeve 18, which interacts with guide sleeve 15 of base 1. In this context, guide sleeve 18 of top part 2 engages guide sleeve 15 of base 1. The two guide sleeves 15 and 18 also serve to limit the upward stroke of top part 2. This is achieved in that the top end of lower guide sleeve 15 is provided with an inward-facing stop 19 and upper guide sleeve 18 is provided with an outward-facing stop 20. After the two guide sleeves 15 and 18 have been pressed together beyond stops 19 and 20 under slight deformation, top part 2 can only move up relative to base 1 until stops 19 and 20 meet.

Spring 16 mentioned above, which acts between base 1 and top part 2, is designed as a helical spring that is integrally moulded on the underside 21 of head 17 of top part 2. When mounted, the bottom end of spring 16 rests on top side 10 of base plate 3 and holds top part 2 in the normal position shown in FIG. 1, where top part 2 is at its highest position and stops 19 and 20 of the two guide sleeves 15 and 18 are in contact.

Cylindrical chamber sleeve 22, which runs radially inside spring 16 from the underside 21 of top part 2, and tube sleeve 12 of base 1 together enclose a compression chamber 23.

Annular compression chamber 23 has an inlet valve 24 at its bottom end and an outlet valve 25 at its top end. Inlet valve 24 is formed by a circumferential sealing lip 26 integrally moulded on tube sleeve 12 above apertures 14. The outer end of sealing lip 26 arches upward at an angle and contacts inner surface 27 of chamber sleeve 22 of top part 2.

Outlet valve 25 is formed by a sealing lip 28, which extends from inner surface 27 of chamber sleeve 22 and the upwardly rounded free end of which rests on outer surface 29 of tube sleeve 12.

Another sealing lip 30 is provided on tube sleeve 12 below apertures 14, where the annular space between the upper sealing lip 26 and the lower sealing lip 30 borders an intermediate chamber 31.

An essentially cylindrical displacement chamber 32, into which upper cap 13 of tube sleeve 12 extends when top part 2 is depressed, is integrally moulded inside head 17, above sealing lip 28 integrally moulded on chamber sleeve 22. A radial outlet channel 33 runs from displacement chamber 32 to the lateral edge of head 17, through which the medium to be transported exits when the pump is operated.

In order to feed air into the container after each pumping cycle, a so-called forced-ventilation element is provided. Forced ventilation takes place from space 34, which is bordered on the outside by the two guide sleeves 15 and 18 and on the inside by tube sleeve 12 and chamber sleeve 22. This intermediate space 34, which also accommodates spring 16, for example, is not sealed off from the outside air, so that outside air from this intermediate chamber 34 can enter the inside of the container through passages 35 provided in base plate 3.

For familiar reasons, forced ventilation may not take place at all times, as the pump would otherwise not function properly. Forced ventilation should preferably only occur when top part 2 is in its lowest position after completing a pumping cycle, as shown in FIG. 2. In order to achieve forced ventilation, a sealing sleeve 36, which extends relatively far upward and has a circumferential sealing lip 37 on its top end, is located on the top side of base plate 3, radially inside spring 16 but radially outside passages 35. Sealing lip 37 contacts the outer surface of chamber sleeve 22, so that passages 35 are not in contact with the outside air. In order to ensure forced ventilation in the lowest position of top part 2, the outer periphery of chamber sleeve 22 is provided with at least one recess 38, which is in the region of sealing lip 37 when top part 2 is depressed, as shown in FIG. 2, and thus creates an air opening to the air passages 35 provided in base plate 3.

When the finger pressure exerted on head 17 of top part 2 decreases and top part 2 moves back up into the normal position shown in FIG. 1 due to the action of spring 16, the forced ventilation element is sealed off again by sealing lip 37 resting against the outer surface of chamber sleeve 22. New medium is thus drawn through riser tube 11, tube sleeve 12, apertures 14, intermediate chamber 31 and into compression chamber 23. The next pumping cycle can begin once top part 2 has reached its highest position, as shown in FIG. 1.

When top part 2 is depressed again, compression chamber 23 becomes smaller due to the fact that tube sleeve 12 slides up relative to top part 2 and inlet valve 24 approaches outlet valve 25. As inlet valve 24 closes when top part 2 is depressed, the medium can only reach displacement chamber 32 through outlet valve 25 by lifting sealing lip 28. From there, the medium flows out through outlet channel 33. Due to the fact that upper cap 13 of the tube sleeve slides into displacement chamber 32 during the pumping cycle and thus reduces its size, the medium is additionally forced out through outlet channel 33 with great force by this auxiliary process.

If the maximum possible stroke of top part 2 is to be utilised for the pumping cycle, the top end of cap 13 of tube sleeve 12 contacts upper dome 39 of displacement chamber 32, as shown in FIG. 2, in the maximally depressed position of top part 2. In this limit position, forced ventilation of the container begins again and the medium is then drawn into compression chamber 23 when the top part travels up under spring force. Once top part 2 has reached its highest position, the pump is ready for the next pumping cycle.

As shown in FIG. 3 in particular, the pump consists of only two individual parts to be manufactured separately, which can be assembled by simply being inserted into one another. After the pump is placed on a container, all the pump parts are located outside the inside of the container, so that they do not have a negative effect on the appearance, for example when glass bottles are used. Furthermore, these pumps have the advantage that they are also suitable for extremely narrow bottle necks.

Each of the individual parts can be injection-moulded from a suitable plastic in a single working step.

Of course, it is also possible to manufacture spring 16 as a separate part, although this would make the overall design and assembly more complex. The preferred configurations of the pump according to the invention thus consist of just two parts, where spring 16 could, of course, also be integrally moulded on the base.

In another adaptation of the invention, various functional parts that are integrally moulded on top part 2 could also be integrally moulded on the base and vice versa.

List of Reference Numbers

1 Base
2 Top part
3 Base plate
4 Underside
5 Mounting element
6 Connector
7 Threads
8 Seal
9 Through-hole
10 Top side
11 Riser tube
12 Tube sleeve
13 Cap
14 Apertures
15 Guide sleeve
16 Spring
17 Head
18 Guide sleeve
19 Stop
20 Stop
21 Underside
22 Chamber sleeve
23 Compression chamber
24 Inlet valve
25 Outlet valve
26 Sealing lip
27 Inner surface
28 Sealing lip
29 Outer surface
30 Sealing lip
31 Intermediate chamber
32 Displacement chamber
33 Outlet channel
34 Intermediate space
35 Air passages
36 Sealing sleeve
37 Sealing lip
38 Recess
39 Upper dome

What is claimed is:

1. Pump for flowable media, particularly a cosmetic pump, provided with a base, which can be mounted tightly on the opening of a container and, when mounted, has an underside facing the container and a top side facing away from the container, a through-hole in the base, which extends from the underside of the base through to its top side, a tube sleeve extending upwards from the top side of the base around the through-hole, an outer guide sleeve likewise extending upwards from the top side of the base, a top part guided on the guide sleeve that can be manually depressed against a compression spring, a compression chamber adjacent to the tube sleeve with an inlet valve and an outlet valve, an outlet channel provided downstream of the outlet valve of the compression chamber, a mounting element provided on the underside of the base for connecting the base to the container, a riser tube extending from the through-hole into the container for drawing in the flowable medium and a forced-ventilation element to the inside of the container that is active when the top part is depressed, characterised in that both the inlet valve (24, 43) and the outlet valve (25, 49) of the compression chamber (23, 44) are designed as integrally moulded lip seals that only allow the medium to pass in the direction of transport, where the medium is drawn into the compression chamber (23, 44) by the upward travel of the top part (2) induced by spring force (16) and forced out of the compression chamber (23, 44) when the top part (2) is depressed.

2. Pump as per claim 1, characterised in that the tube sleeve (12) of the base (1) is designed as an elongated cylinder that is closed at the top end.

3. Pump as per claim 2, characterised in that the compression chamber (23) is located between the outer surface (29) of the tube sleeve (12) and the inner surface (27) of a chamber sleeve (22) located on the top part (2) concentric to the tube sleeve (12).

4. Pump as per claim 3, characterised in that the lip seal that serves as the inlet valve (24) is located on the outer periphery of the tube sleeve (12) with its sealing lip (26) in contact with the inner surface (27) of the chamber sleeve (22), and in that the tube sleeve (12) is provided below the sealing lip (26) with at least one aperture (14) for the medium to be transported.

5. Pump as per claim 4, characterised in that the lip seal (28) that serves as the outlet valve (25) is located on the inner periphery of the chamber sleeve (22) provided on the top part (2).

6. Pump as per claim 5, characterised in that a displacement chamber (32), into which the tube sleeve (12) defined as a cylinder closed at the top projects, is located above the outlet valve (25) inside the chamber sleeve (22) and/or the top part (2).

7. Pump as per one of claim 4, characterised in that another circumferential sealing lip (30), which also contacts the inner surface of the chamber sleeve (22), is provided below the aperture (14) of the tube sleeve (12), where the area between the two sealing lips (26, 30) provided on the tube sleeve (12) forms an intermediate chamber (31).

8. Pump as per one of claim 3, characterised in that the base (1) is provided with a sealing lip (37) that contacts the outer periphery of the chamber sleeve (22), in that the outer periphery of the chamber sleeve (22) has at least one recess (38), which is in the region of the sealing lip (37) when the top part (2) is depressed and thus creates an air opening, and in that at least one air passage (35) is provided in the base (1) between the tube sleeve (12) and the sealing lip (37).

9. Pump as per one of claim 1, characterised in that the top part (2) is provided with a corresponding guide sleeve (18) that interacts with the guide sleeve (15) of the base (1), and in that the two guide sleeves (15, 18) have stops (19, 20) to limit the upward stroke of the top part (2).

10. Pump as per one of claim 1, characterised in that the tube sleeve (12) of the base (1) and the chamber sleeve (22) of the top part (2) are concentric relative to one another.

* * * * *

UNITED STATES PATENT AND TRADEMARK OFFICE

CERTIFICATE OF CORRECTION

PATENT NO. : 6,814,263 B2
DATED : November 9, 2004
INVENTOR(S) : Rosenthal

It is certified that error appears in the above-identified patent and that said Letters Patent is hereby corrected as shown below:

Column 6,
Lines 59 and 65, after the word "per", delete the words "one" and "of".

Signed and Sealed this

Third Day of May, 2005

JON W. DUDAS
*Director of the United States Patent and Trademark Office*